US007592114B2

(12) United States Patent
Lee et al.

(10) Patent No.: US 7,592,114 B2
(45) Date of Patent: Sep. 22, 2009

(54) COLOR TONER FOR NON-MAGNETIC MONO-COMPONENT SYSTEM FOR INCREASING PRINTING QUALITY AND A METHOD FOR PREPARING THE SAME

(75) Inventors: Hyeung-Jin Lee, Daejeon (KR); Joo-Yong Park, Daejeon (KR); Chang-Soon Lee, Daejeon (KR)

(73) Assignee: LG Chem Ltd., Seoul (KR)

( * ) Notice: Subject to any disclaimer, the term of this patent is extended or adjusted under 35 U.S.C. 154(b) by 438 days.

(21) Appl. No.: 11/332,511

(22) Filed: Jan. 17, 2006

(65) Prior Publication Data

US 2006/0160008 A1 Jul. 20, 2006

(30) Foreign Application Priority Data

Jan. 18, 2005 (KR) ..... 10-2005-0004565
Jan. 17, 2006 (KR) ..... 10-2006-0004769

(51) Int. Cl.
*G03G 9/093* (2006.01)

(52) U.S. Cl. ..... 430/108.3; 430/108.4; 430/110.2; 430/137.21

(58) Field of Classification Search ..... 430/108.3, 430/110.2, 108.4, 137.21
See application file for complete search history.

(56) References Cited

U.S. PATENT DOCUMENTS 4,837,101 A 6/1989 Gruber et al.
4,948,686 A 8/1990 Koch et al.
5,275,905 A 1/1994 Ciccarelli et al.
5,350,657 A 9/1994 Anno et al.
5,506,083 A 4/1996 Nash et al.
5,620,824 A 4/1997 Okado et al.
5,683,845 A 11/1997 Sata et al.
5,905,011 A 5/1999 Kurose et al.
6,022,661 A * 2/2000 Kurose et al. ..... 430/108.7
6,103,441 A 8/2000 Tomita et al.

(Continued)

FOREIGN PATENT DOCUMENTS

JP 02-161469 6/1990
JP 4-186251 7/1992
JP 5-61244 3/1993
JP 6-118699 4/1994
JP 7-64330 3/1995

(Continued)

OTHER PUBLICATIONS

Arthur S. Diamond; "Handbook of Imaging Materials", Diamond Research Corporation, Ventura, California; Marcel Dekker, Inc., New York; Basel; Hong Kong, pp. 169-170.

*Primary Examiner*—John L Goodrow
(74) *Attorney, Agent, or Firm*—McKenna Long & Aldridge LLP

(57) ABSTRACT

The present invention relates to a color toner for a nonmagnetic mono-component printing system that improves the printing characteristics, and a preparation method thereof. More specifically, the present invention provides a color toner including a first coating layer and a second coating layer formed on a toner mother particle, wherein the first coating layer contains coated organic powders where two kinds of organic powders are coated with each other, and the second coating layer contains coated inorganic powders where silica and titanium dioxide are coated with each other. The color toner of the present invention has a narrow charge distribution, good image density, high transfer efficiency, excellent long-term stability, and reduced PCR contamination, thereby being good for use in high speed color printers, etc., employing a direct type or a tandem type of transfer system.

11 Claims, 3 Drawing Sheets

U.S. PATENT DOCUMENTS

| | | | | |
|---|---|---|---|---|
| 6,127,081 | A | 10/2000 | Yamauchi | |
| 6,174,641 | B1 | 1/2001 | Nakamura et al. | |
| 6,187,489 | B1 | 2/2001 | Oishi et al. | |
| 6,348,291 | B1 | 2/2002 | Sato | |
| 6,638,676 | B2 | 10/2003 | Miyamoto | |
| 6,777,151 | B2 | 8/2004 | Hagi et al. | |
| 7,312,009 | B2 * | 12/2007 | Lee et al. | 430/108.3 |
| 7,374,846 | B2 * | 5/2008 | Lee et al. | 430/108.11 |
| 2002/0192582 | A1 | 12/2002 | Yamazaki et al. | |
| 2003/0157419 | A1 | 8/2003 | Miyakawa et al. | |
| 2004/0097623 | A1 | 5/2004 | Koeda et al. | |
| 2005/0153225 | A1 * | 7/2005 | Lee et al. | 430/108.6 |
| 2005/0238986 | A1 | 10/2005 | Itoh | |

FOREIGN PATENT DOCUMENTS

| | | | |
|---|---|---|---|
| JP | 7-168388 | | 7/1995 |
| JP | 11-38670 | | 2/1999 |
| JP | 11-338182 | | 12/1999 |
| JP | 2000-29242 | | 1/2000 |
| JP | 2000-267346 | | 9/2000 |
| JP | 2000-275900 | | 10/2000 |
| JP | 2001-242659 | | 9/2001 |
| JP | 2002-214834 | | 7/2002 |
| JP | 2004-070076 | | 3/2004 |
| KR | 1996-0024716 | | 7/1996 |
| KR | 1020020061681 | A | 7/2002 |
| KR | 1020020061682 | A | 7/2002 |
| KR | 1020030056152 | A | 7/2003 |
| WO | WO 03/087951 | | 10/2003 |

* cited by examiner

COLOR TONER FOR NON-MAGNETIC MONO-COMPONENT SYSTEM FOR INCREASING PRINTING QUALITY AND A METHOD FOR PREPARING THE SAME

CROSS REFERENCE TO RELATED APPLICATION

This application claims priority to and the benefit of Korean Application Nos. 10-2005-0004565 filed on Jan. 18, 2005 and 10-2006-0004769 filed on Jan. 17, 2006 in the Korean Patent Office, the entire content of which is incorporated hereinto by reference.

BACKGROUND OF THE INVENTION

1. Field of the Invention

The present invention relates to a color toner for non-magnetic mono-component system, and more specifically to the color toner having a narrow charge distribution, good image density, high transfer efficiency, and excellent long-term stability.

2. Description of the Related Art

With digitalization, recent printing techniques are rapidly moving toward full color from black-and-white. In addition, as digital devices are becoming widely used, much research is being devoted to improving image-forming methods and the color toners used to achieve high image quality.

In general, the toner is prepared by using a binder resin, a colorant, a charge control agent, and a releasing agent through the kneading milling method, the suspension polymerization method, the emulsion polymerization method and emulsion aggregation process, etc.

The toner particles are developed with the triboelectrostatic method, and carry a positive or negative charge depending on the polarity of the developed electrostatic latent image. In this process, the composition of components of the toner mother particle, and mainly the additives on the surface of the toner mother particle determine the electrification capability of a toner. Thus, the composition and the method of mixing and adding the additives can be varied to control the electrification capability.

Generally, in the developing process, the additives are used for the purpose of reducing the resistance of the rotating unit which rotates the developing sleeve in the toner supply part, and for preventing the toner from fusing or cohering to the charging blade. Moreover, they can stabilize the triboelectrification characteristic and improve the charge maintenance, and provide a uniform stabilized toner layer formed at low torque and having triboelectrification characteristic in a specific range. However, when the additives are not added uniformly on the toner surface, the charge of toner is not uniform, and a uniform image cannot be formed. In addition, even if the additives are uniformly coated on the toner, adherence between toner and toner, toner and charge blade, or toner and sleeve can happen as printing progresses, in case of toner. In this case, the image grows dim and uneven in the long term. Therefore, to resolve this problem, a design for selecting the proper type, content, and particle size, etc. of the additive is very important.

Particularly, in line with the recent rapid improvement of digital devices, a printer toner to achieve high speed and high quality of color image is required. A toner with a higher and more exact transfer capacity and stable electrification capability in the long term is required.

SUMMARY OF THE INVENTION

To solve the above problems, an embodiment of the present invention provides a color toner that has narrow charge distribution, high charge capacity, excellent image density, and transfer efficiency, and which does not cause contamination of the photoconductive drum and charging roller, and a preparation method thereof.

Another embodiment of the present invention provides a color toner for a non-magnetic mono-component printing system including a first coating layer and a second coating layer formed on a toner mother particle, wherein the first coating layer contains coated organic powders where two kinds of organic powders are coated with each other, and the second coating layer contains coated inorganic powders where the silica and titanium dioxide are coated with each other.

A further embodiment of the present invention provides a process of preparing a color toner including the steps of:

a) preparing a coated organic powder by mixing and coating two kinds of organic powder with each other;

b) coating the coated organic powder on a toner mother particle to produce the toner mother particle with a first coating layer;

c) preparing a coated inorganic powder by mixing and coating silica and titanium dioxide with each other; and d) coating the coated inorganic powder on the toner mother particle with the first coating layer to produce a toner particle including the first coating layer and the second coating layer formed on the toner mother particle.

The color toner includes preferably two kinds of organic powders with average particle size of 0.1 μm to 1.8 μm in an amount of 0.1 to 2.0 parts by weight respectively, silica with average particle size of 3 nm to 40 nm in an amount of 1.0 to 4.0 parts by weight, and titanium dioxide with 80 to 200 nm in an amount of 0.1 to 2.0 parts by weight, based on 100 parts by weight of the toner mother particle.

The thickness of the first coating layer is 10 nm to 200 nm, and the thickness of the second coating layer is 3 nm to 400 nm.

Moreover, it is preferable that the toner mother particle includes a binder resin, a colorant, and a charge control agent.

It is preferable that the coating of the color toner is performed by using a mixer selected from the group consisting of a Henschel mixer, a turbine agitator, a super mixer, and a hybridizer.

DETAILED DESCRIPTION OF THE ILLUSTRATED EMBODIMENTS

Hereinafter, the present invention is described in more detail.

The characteristics of the additives on the surface of the toner particle have a significant effect on the electrification capability and electric charge retention of the toner.

Figure 1:
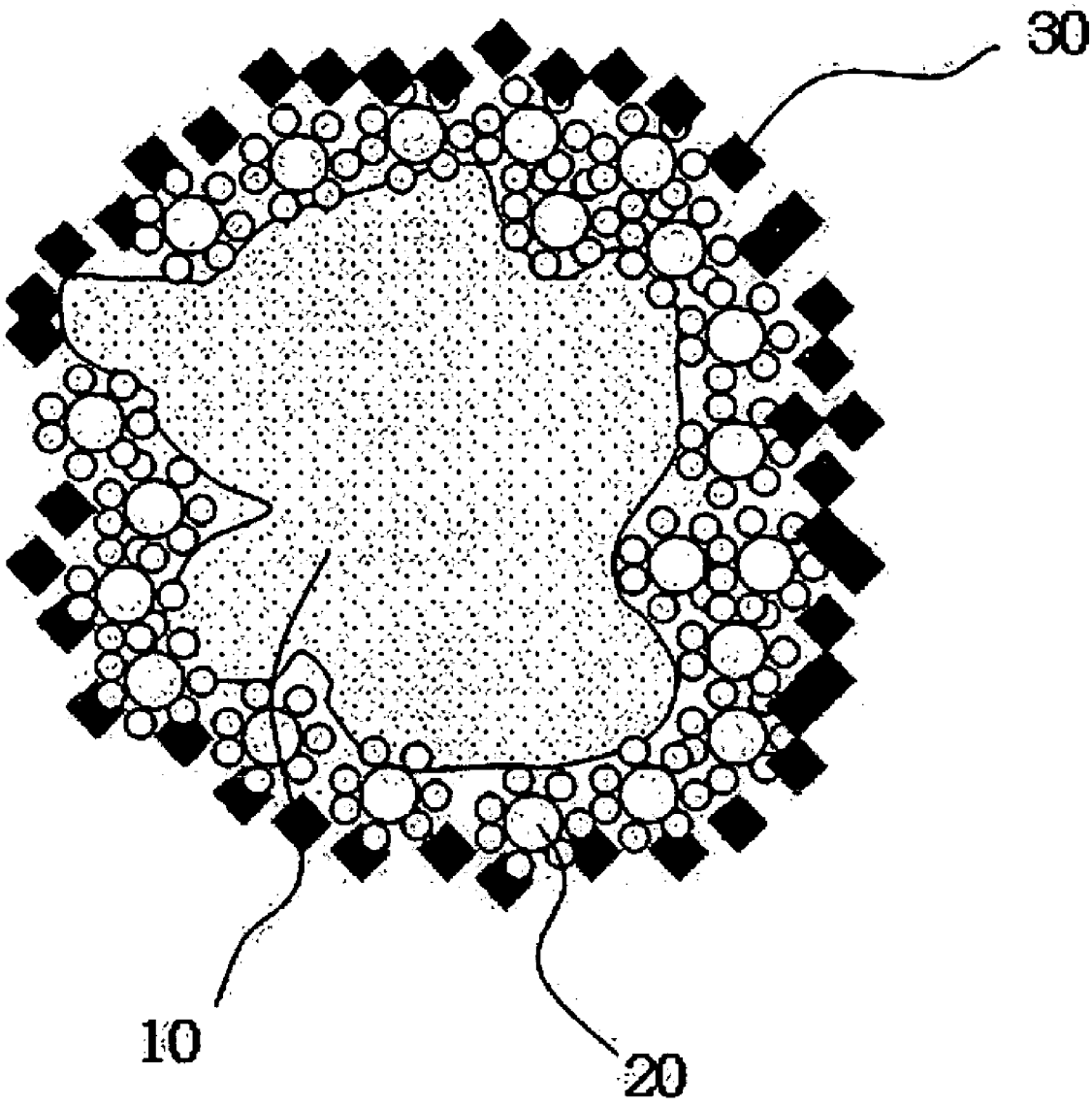
FIG. 1 is a cross-sectional view showing the structure of a non-magnetic one-component color toner according to the present invention.

FIG. 1 is a cross-sectional view showing the structure of the color toner. Referring to FIG. 1, the color toner includes a first coating layer 20 and a second coating layer 30 formed on a toner mother particle 10, wherein the first coating layer 20 contains coated organic powders where two kinds of organic powders are coated with each other, and the second coating layer 30 contains coated inorganic powders where silica and titanium dioxide are coated with each other.

In the present invention, the toner mother particle 10 is not particularly limited. The toner mother particle includes a binder resin, a colorant, and a charge control agent as essential components, and can be prepared by the kneading milling method, the suspension polymerization method, or can be purchased. The toner mother particle may be spherical or irregularly shaped. If necessary, the toner can further include additives such as a fluidity promoting agent and a releasing agent. For example, the toner mother particle includes 90 to 120 parts by weight of binder, 0.5 to 20 parts by weight of colorant, and 0.5 to 10 parts by weight of charge control agent, and may further include 0.1 to 10 parts by weight of fluidity promoting agent or 0.1 to 10 parts by weight of releasing agent.

The binder resin may be one or a mixture of: acrylate-based polymers such as poly(methylacrylate), poly(ethylacrylate), poly(butylacrylate), poly(2-ethylhexylacrylate), and poly (laurylacrylate); methacrylate-based polymers such as poly (methylmethacrylate), poly(butylmethacrylate), poly(hexylmethacrylate), poly(2-ethylhexylmethacrylate), and poly (laurylmethacrylate); an acrylate methacrylate copolymer; a copolymer of a styrene-based monomer and acrylates or methacrylates; an ethylene-based homopolymer or copolymer such as poly(vinylacetate), poly(vinylpropinate), poly (vinylbutylrate), polyethylene, and polypropylene; a styrene-based copolymer such as styrene-butadiene copolymer, styrene-isoprene copolymer, styrene-malerate copolymer; a polystyrene-based resin; a polyvinylether-based resin; a polyvinylketone-based resin; a polyester-based resin; a polyurethane-based resin; an epoxy resin; or a silicone resin.

Preferably, the polymer is at least one selected from the group consisting of a polystyrene-based resin, a polyester-based resin, a polyethylene resin, a polypropylene resin, a styrene alkylacrylate copolymer of C1 to C18, styrene alkylmethacrylate copolymer, styrene acrylonitrile copolymer, styrene butadiene copolymer, and styrene malerate copolymer.

The colorant is used for the present invention in a concentration required to form a visible image. The colorant can be any colorant being generally used for a color printer, and includes cyan, magenta, magnetic components showing yellow and black, dye, and pigment. Carbon black is generally used for the black colorant.

Examples of the yellow colorant include a condensed nitrogen-containing compound, an isoindolinone compound, an anthraquinone compound, an azo metal complex, and allylamide, which are directly synthesized or purchased. Specific examples of the yellow colorant include Chrome yellow chloride, C.I. pigment yellow 97, C.I. pigment yellow 12, C.I. pigment yellow 17, C.I. pigment yellow 14, C.I. pigment yellow 13, C.I. pigment yellow 16, C.I. pigment yellow 81, C.I. pigment yellow 126, and C.I. pigment yellow 127, but are not limited thereto.

For the magenta colorant, a condensed nitrogen-containing compound, an anthraquinone compound, a quinacridone compound, a basic dye lake compound, a naphthol compound, a benzoimidazole compound, a thioindigo compound, or a perylene compound is used. Specific examples of the magenta compound include rose Bengal, C.I. pigment red 48:1, C.I. pigment red 48:4, C.I. pigment red 122, C.I. pigment red 57:1, and C.I. pigment red 257.

For the Cyan colorant, a phthalocyanine compound and its derivatives, an anthraquinone compound, and a basic dye lake compound can be used. Specific examples of the cyan colorant include nigrosine dye, aniline blue, charcoal blue, chrome yellow, purplish-blue, dupont oil red, methylene blue chroride, phthalocyanine blue, lamp black, C.I. pigment blue 9, C.I. pigment blue 15, C.I. pigment blue 15:1, C.I. pigment blue 15:3, etc.

The charge control agent includes metal-containing azo dye and salicylic acid metal complex as a charge control agent with a negative charge, and quaternary ammonium salt and nigrosine dye as a charge control agent with a positive charge.

The fluidity promoting agent can be optionally added to the toner mother particle, and is at least one selected from the group consisting of $SiO_2$, $TiO_2$, MgO, $Al_2O_3$, ZnO, $Fe_2O_3$, CaO, $BaSO_4$, $CeO_2$, $K_2O$, $Na_2O$, $ZrO_2$, $CaO.SiO_2$, $K_2O.TiO_2$, and $Al_2O_3.2SiO_2$, which are hydrophobically treated with hexamethyldisilazane, dimethyl-dichloro silane, or octyl trimethoxy silane.

The releasing agent can be used to prevent off-set of the toner mother particle. The releasing agent can be waxes or olefin-based polymers with low molecular weight which are used generally in this technical field. For example, the olefin-based polymers are polypropylene, polyethylene, propylene ethylene copolymer, etc.

Particularly, in order to improve various characteristics of the toner, the coated organic powders and the coated inorganic powders are sequentially coated on the toner mother particle 10 to form the first coating layer 20 and the second coating layer 30 on the surface of the toner mother particle 10.

By contacting with a charging blade surface in the electric charging of the photoconductive drum, the coated organic powders in the first coating layer 20 reduce the frictional resistance that is put on the toner located between the sleeve and the charging blade. Thus, the toner particles are not deposited on the photoconductive drum, thereby providing a stable image for a long period. In addition, the coated organic powders can help the coated inorganic powders in the second coating layer 30 to be well coated on the toner mother particle and reduce adhesion force occurring between the toner particles, thereby maintaining charge capacity.

To perform the functions of the organic powder, the coated organic powders are prepared by mixing two kinds of organic powders with different size, and then are coated on the surface of the toner mother particle.

By using two kinds of organic powders with different particle size in the first coating layer 20, the spherical organic powder with small particle size can effectively fill the concave regions in the surface of the irregularly-shaped toner mother particle, as shown in FIG. 1. As a result, the irregularly-shaped toner mother particle can behave like a spherical particle, and thus have uniform surface charging characteristics.

Therefore, the toner layer is evenly formed on the developing sleeve to obtain a uniform image for a long period and to improve transfer efficiency. However, when an organic powder is used as in the conventional art, the concave regions with different size and shape cannot be filled, thereby producing a toner with an uneven surface. Therefore, a uniform charge characteristic cannot be achieved.

The two kinds of organic powder in the first coating layer 20 have 0.1 μm to 1.8 μm of number average particle size, respectively, and preferably organic powders with different particle size can be mixed. If the average particle size of the organic powder is greater than 1.8 μm, it reduces adhesion to the toner surface and cannot fill the concave regions of the irregularly-shaped toner. Thus, the toner cannot behave as a spherical toner particle. In contrast, if it is lower than 0.1 μm, it cannot reduce the friction resistance effectively, and cannot fill the concave regions of the irregularly-shaped toner completely. Thus, the effect of the spherical toner cannot be obtained. In addition, when the particle size of the organic powder is excessively small, it is very difficult to control the organic powder to fill a suitable region of the toner mother particle 10.

The thickness of the first coating layer 20 is 10 nm to 200 nm. Particularly, the number average particle size of the toner particles having the first coating layer 20 can be slightly different but this does not have a large effect on the total particle size of the toner because the organic powder fills the concave regions of the toner particles without coating the toner surface uniformly.

In consideration of the cohesive property of the coated organic powders to the toner surface and the second coating layer, the amount of the coated organic powders can be determined. Preferably, they can be used in an amount of 0.2 to 4.0 parts by weight, and the amount of each organic powder is 0.1 to 2.0 parts by weight based on 100 parts by weight of the toner mother particle. If the amount of the coated organic powders is less than 0.2 parts by weight, it is difficult to obtain the effect of the organic powders. If it is more than 4.0 parts by weight, uniform charging capacity cannot be obtained, and contamination of the charging roller and drum lower the transfer efficiency.

The organic powder is (a) a homopolymer or a copolymer prepared from one or more monomers selected from the group consisting of: styrenes such as styrene, methyl styrene, dimethyl styrene, ethyl styrene, phenyl styrene, chloro styrene, hexyl styrene, octyl styrene, and nonyl styrene; vinylhalides such as vinylchloride and vinylfluoride; vinylesters such as vinylacetate and vinylbenzoate; methacrylates such as methylmethacrylate, ethyl methacrylate, propyl methacrylate, n-butyl methacrylate, iso-butyl methacrylate, 2-ethylhexyl methacrylate, and phenyl methacrylate; acrylic acid derivatives such as acrylonitrile, and methacrylonitrile; acrylates such as methylacrylate, ethylacrylate, butylacrylate, and phenylacrylate; tetrafluoroethylene; and 1,1-difluoroethylene, or (b) a mixture of a polymer selected from the group consisting of the homopolymer and the copolymer of (a) and a resin selected from the group consisting of a styrene-based resin, an epoxy-based resin, a polyester-based resin, and a polyurethane-based resin.

In accordance with a preferred embodiment of the present invention, toners including organic powders having a different particle size in different amounts were prepared and tested for toner characteristics. As a result, in comparison with a toner including organic powders in an amount and number average particle size outside of the present invention, the toners of the present invention have excellent image density, transfer efficiency, long-term stability, and low contamination of the drum.

According to the present invention, the coated inorganic powders forming the second coating layer 30 include silica and titanium dioxide.

The silica in the second coating layer 30 lowers the adhesive force between the toner and the drum, thereby improving transfer efficiency. Titanium dioxide with low electric resistance increases the relative number of toner particles which have charging capacity in a specific range among toner particles located on the sleeve, thereby improving the gradation. More specifically, the coated inorganic powders have the structure of silica coated on the titanium oxide by mixing silica with a comparatively small particle size and titanium oxide with a relatively large particle size.

Like the thickness of the first coating layer, it is difficult to define that of the second coating layer. However, the first coating layer can be coated to form the spherical shape of the toner to the some extent. Thus, the second coating layer 30 is formed on the relatively spherical toner in a uniform thickness, for example 3 nm to 400 nm.

Silica with excellent exfoliation capacity plays the role of lowering the adhesive force between the drum and the toner. The number average particle size of the silica is 3-40 nm, preferably 5-30 nm. At this time, adhesion between the coated inorganic powders and the first coating layer 20 decreases, in a case that the particle size of the silica is greater than 40 nm. If it is less than 3 nm, the adhesive force between the drum and the toner cannot be sufficiently reduced. Thus, the particle size of the inorganic powder can be selected suitably within the range.

The amount of silica can be determined in consideration of the adhesive force between the toner and drum, and between the silica and the first coating layer 20. Preferably, based on 100 parts by weight of the toner mother particle, the amount of silica is 1.0 to 4.0 parts by weight, more preferably 1.5 to 3.5 parts by weight. The adhesion force of the silica to the first coating layer decreases if the amount exceeds 4.0 parts by weight. An uneven image can be generated under low temperature and low humidity and a non-imaging region is seriously contaminated under high temperature and high humidity because of the environmental dependence of the silica. If the amount is less than 1.0 part by weight, it is difficult to obtain the low adhesive force between the toner particles and drum, thereby reducing the transfer efficiency. Accordingly, the mount of silica can be adjusted within the range.

The silica can be silica itself, or hydrophobically-treated silica with a surface modifying agent for improving the environmental characteristics where the transfer efficiency can be improved by maintaining the charge characteristic under high temperature and high humidity, or under low temperature and low humidity. The silica with hydrophobic treatment can be prepared by a surface modifying agent selected from the group consisting of dimethyl dichlorosilane, dimethyl polysiloxane, hexamethyldisilazane, aminosilane, alkylsilane, and octamethylcyclotetrasiloxane.

Because titanium dioxide has lower electric resistance and high charge exchanging capacity than those of silica, it makes the charge distribution narrow. Thus, titanium dioxide makes the image tender, reproduces an image just like a photograph by improving gradation, and compensates the low environmental characteristics of silica. Preferably, titanium dioxide having a Rutile structure which is stable at a high temperature, or an Anatase structure which is stable at a low temperature can be used alone, or as a mixture thereof. The number average particle size of titanium dioxide is 80 to 200 nm, more preferably 100 to 150 nm. If the particle size is greater than 200 nm, its adhesion force to the first coating layer decreases. If it less than 80 nm, it is not possible to expect the effect of the addition of titanium dioxide. Therefore, the particle size of titanium dioxide can be selected suitably within the range.

The preferred amount of titanium dioxide is 0.1 to 2.0 parts by weight, more preferably 0.15 to 1.8 parts by weight, based on 100 parts by weight of the toner mother particle. If it exceeds 2.0 parts by weight, the toner cannot easily adhere to the second coating layer, and scratches the photoconductive drum, thereby causing drum filming. If the amount is less than 1.0 part by weight, it is difficult to expect the effect of addition of the titanium dioxide. Therefore, the amount of titanium dioxide can be selected suitably within the range.

According to the desired embodiment of the present invention, image density, transfer efficiency, long-term stability, and drum contamination were measured by changing the particle size and amount of the silica and titanium dioxide. As a result, compared to the comparative example which uses an amount and particle size of silica and titanium dioxide outside of the present invention, the characteristics of the toner of the present invention have excellent test results (see Tables 8 and 11).

According to the present invention, each step of the method of preparing the color toner will be explained.

a) Step of Preparing the Coated Organic Powders.

In step a), 2 kinds of spherical organic powders are mixed and coated on each particle's surface.

It is more preferable to select two kinds of organic powder with different particles size, to easily coat with each other.

The coating of the organic powders is different from deposition, and the mixing for coating the particles with each other is different to a simple mixing method. That is, the mixing and the coating of the two kinds of organic powders means that a kind of organic powder with a specific functional group adheres to or embeds in a specific region of the other kind of organic powder by blending them, so as to have the characteristics of two kinds of organic powders together.

The mixing can be performed by a mechanical mixing method using a mixer selected from the group consisting of a Henschel mixer, a turbine agitator, a super mixer, and a hybridizer at tip speed of 1 to 10 m/s, more preferable 3 to 7 m/s, for 1 minute to 5 minutes. The mixing condition can be changed depending on the factors such as the kind and capacity of the mixer.

b) Step of Preparing the First Coating Layer

In step b), the surface of the toner mother particle is coated by mixing the coated organic powders obtained in step a) with the toner mother particle to prepare the first coating layer.

The coating can be performed by using a general mechanical mixer, preferably a mixer as described above at a tip speed of 5 to 30 m/s, more preferably 10 to 20 m/s for 5 to 20 minutes. Such mechanical mixing can make it easy for the coated organic powders to adhere to the toner mother particle, thereby preventing the organic powder from releasing.

c) Step of Preparing the Coated Inorganic Powder.

In step c), two kinds of spherical powders including silica and titanium dioxide are mixed in a certain mixing ratio to coat the surface of the inorganic powders with each other.

The mixing can be performed with the mixing method and the mixer of step a), and the tip speed is 1 to 10 m/s, preferably 3 to 7 m/s, and the mixing time is 1 minute to 5 minutes.

d) Step of Preparing the Second Coating Layer.

In step d), the surface of the toner mother particle with the first coating layer is coated by mixing the toner particle with the second coating layer obtained in step c) to produce a toner particle including the first coating layer and the second coating layer formed on the toner mother particle.

The mixing can be performed according to a similar method to the mixing method and the mixer in step b), and the tip speed is 5 to 30 m/s, preferably 10 to 20 m/s, and the mixing time is 5 minute to 20 minutes.

The color toner prepared by this method has a number average particle size of at most 20 μm, preferably 3 to 15 μm, and has the improved characteristics required for the toner such as image density, transfer efficiency, long-term stability, and capacity of preventing drum contamination, thereby showing high charge capacity, charge maintenance, and high chromaticity.

In particular, the toner reduces the pressure occurring between the sleeve and the charge blade, and the adhesion force between the toner particles which increases as they are pressed continuously. Because it prevents the toner particles from adhering to each other in printing for a long time, the charging state of the toner is maintained uniform with that of the initial stage. In addition, because organic powders fill the concave region of the irregularly-shaped toner mother particle, the uniform charging state provides consistent transfer efficiency and improved long-term stability. In addition, an amount of waste toner decreases, and thus the present invention is environmentally friendly.

As the trend is towards high speed and colorful printers, a color toner having the above characteristics can be applied to high speed color printers, etc. employing a direct type or a tandem type of transfer system.

Hereinafter, the present invention is described in more detail through examples. However, the following examples are given only for the understanding of the present invention and they do not limit the present invention.

EXAMPLE 1

1-1: Preparation of Cyan Toner Mother Particle 94 parts by weight of polyester resin (molecular weight=$2.5\times10^5$), 5 parts by weight of phthalocyanine P.BI.15:3, 1 part by weight of azo metal complex as a charge control agent, and 3 parts by weight of polypropylene having a low molecular weight were mixed using a HENSCHEL mixer. The mixture was melted and kneaded at 165 □ using a twin melt kneader, crushed using a jet mill crusher, and classified using an air classifier to obtain a toner mother particle having a volume-average particle size of 7.2 μm.

1-2: Preparation of the First Coating Layer

Based on 100 parts by weight of the toner mother particle prepared as above, 0.5 parts by weight of polytetrafluoroethylene (PTFE) having an average particle size of 0.1 μm and 0.5 parts by weight of PMMA having an average particle size of 0.1 μm as a spherical organic powder were mixed using a HENSCHEL mixer at a tip speed of 5 m/s to coat each other. The toner mother particle prepared as above was coated with the coated organic powder in a HENSCHEL mixer at a tip speed of 15 m/s for 5 minutes to obtain the first coating layer on the toner mother particle.

1-3: Preparation of the Second Coating Layer

Then, based on 100 parts by weight of the toner mother particle prepared as above, 2.5 parts by weight of silica having an average particle size of 17 nm and 1.0 parts by weight of titanium dioxide having an average particle size of 150 nm as inorganic powder were mixed using a HENSCHEL mixer at a tip speed of 5 m/s to coat each other.

The toner mother particle having the first coating layer prepared as above was coated with the coated inorganic powder in a HENSCHEL mixer at a tip speed of 15 m/s for 5 minutes to obtain the second coating layer on the toner mother particle.

EXAMPLES 2 TO 25

To test the effect of the particle size and the amount of spherical organic powders on the toner characteristics, Examples 2-25 were prepared according to substantially the same method as in Example 1, except that the compositions were as shown in Table 1. Each example used polytetrafluroethylene (PTFE), polymethylmethacrylate (PMMA), polyvinylidene fluoride (PVDF), and silicon powder as the organic powders. The number average particle size and the amount of the organic powders ranged from 0.1 to 1.5 μm, and 0.5 to 1.5 parts by weight, respectively.

TABLE 1

| | Organic powder (average particle size, material, amount (parts by weight)) | Inorganic powder: Silica average particle size, amount (parts by weight) | Inorganic powder: Titanium dioxide average particle size, amount (parts by weight) |
|---|---|---|---|
| Example 2 | 0.1 μm, PTFE, 0.5<br>0.4 μm, PMMA, 0.5 | 6 nm/2.5 | 150 nm/1.0 |
| Example 3 | 0.1 μm, PTFE, 0.5<br>0.8 μm, PMMA, 0.5 | 6 nm/2.5 | 150 nm/1.0 |
| Example 4 | 0.1 μm, PVDF, 0.5<br>1.5 μm, PMMA, 0.5 | 6 nm/2.5 | 150 nm/1.0 |
| Example 5 | 0.4 μm, PVDF, 0.5<br>1.5 μm, PMMA, 0.5 | 6 nm/2.5 | 150 nm/1.0 |
| Example 6 | 0.4 μm, PVDF, 1.0<br>0.1 μm, PMMA, 0.5 | 6 nm/2.0 | 150 nm/1.0 |
| Example 7 | 0.4 μm, PVDF, 1.0<br>0.8 μm, PMMA, 0.5 | 6 nm/2.5 | 150 nm/1.0 |
| Example 8 | 0.8 μm, PVDF, 1.0<br>0.1 μm, PMMA, 0.5 | 6 nm/2.5 | 150 nm/1.0 |
| Example 9 | 0.8 μm, PVDF, 1.0<br>0.4 μm, PMMA, 0.5 | 6 nm/2.5 | 150 nm/1.0 |
| Example 10 | 0.8 μm, PVDF, 1.0<br>1.5 μm, PMMA, 0.5 | 6 nm/2.5 | 150 nm/1.0 |
| Example 11 | 1.5 μm, PVDF, 1.5<br>0.4 μm, PMMA, 0.5 | 6 nm/2.5 | 150 nm/1.0 |
| Example 12 | 1.5 μm, PVDF, 1.5<br>0.8 μm, PMMA, 0.5 | 6 nm/2.5 | 150 nm/1.0 |
| Example 13 | 0.8 μm, PVDF, 1.5<br>1.5 μm, PMMA, 0.5 | 6 nm/2.5 | 150 nm/1.0 |
| Example 14 | 1.5 μm, PVDF, 1.5<br>0.4 μm, PMMA, 0.5 | 6 nm/2.5 | 150 nm/1.0 |
| Example 15 | 0.4 μm, silicon powder, 0.5<br>0.1 μm, PMMA, 0.5 | 6 nm/2.5 | 150 nm/1.0 |
| Example 16 | 0.4 μm, silicon powder, 0.5<br>0.8 μm, PMMA, 0.5 | 6 nm/2.5 | 150 nm/1.0 |
| Example 17 | 0.4 μm, silicon powder, 0.5<br>1.5 μm, PMMA, 0.5 | 6 nm/2.5 | 150 nm/1.0 |
| Example 18 | 0.8 μm, silicon powder, 1.0<br>0.1 μm, PMMA, 0.5 | 6 nm/2.5 | 150 nm/1.0 |
| Example 19 | 0.8 μm, silicon powder 1.0<br>0.4 μm, PMMA, 0.5 | 6 nm/2.5 | 150 nm/1.0 |
| Example 20 | 0.8 μm, silicon powder, 1.0<br>0.8 μm, PMMA, 1.0 | 6 nm/2.5 | 150 nm/1.0 |
| Example 21 | 0.8 μm, silicon powder, 1.0<br>1.5 μm, PMMA, 1.5 | 6 nm/2.5 | 150 nm/1.0 |
| Example 22 | 1.5 μm, silicon powder, 1.5<br>0.1 μm, PMMA, 0.5 | 6 nm/2.5 | 150 nm/1.0 |
| Example 23 | 1.5 μm, silicon powder, 1.5<br>0.4 μm, PMMA, 0.5 | 6 nm/2.5 | 150 nm/1.0 |

TABLE 1-continued

| | Organic powder (average particle size, material, amount (parts by weight)) | Inorganic powder: Silica average particle size, amount (parts by weight) | Inorganic powder: Titanium dioxide average particle size, amount (parts by weight) |
|---|---|---|---|
| Example 24 | 1.5 μm, silicon powder, 1.5<br>0.8 μm, PMMA, 1.0 | 6 nm/2.5 | 150 nm/1.0 |
| Example 25 | 1.5 μm, silicon powder, 1.5<br>1.5 μm, PMMA, 1.5 | 6 nm/2.5 | 150 nm/1.0 |

EXAMPLES 26 TO 43

To test the effect of the amount and the particle size of silica on the toner characteristics, Examples 26-43 were prepared according to substantially the same method as in Example 1, except that the compositions were as shown in Table 2. The number average particle size and the amount of silica ranged from 6 to 40 nm, and 0.5 to 1.5 parts by weight, respectively.

TABLE 2

| | Organic powder (average particle size, material, amount (parts by weight)) | Inorganic powder: Silica average particle size, amount (parts by weight) | Inorganic powder: Titanium dioxide average particle size, amount (parts by weight) |
|---|---|---|---|
| Example 26 | 0.1 μm, PTFE, 0.5<br>0.4 μm, PMMA, 0.5 | 6 nm, 1.0 | 150 nm, 1.0 |
| Example 27 | 0.1 μm, PTFE, 0.5<br>0.8 μm, PMMA, 0.5 | 6 nm, 2.0 | 150 nm, 1.0 |
| Example 28 | 0.1 μm, PVDF, 0.5<br>1.5 μm, PMMA, 0.5 | 6 nm, 3.0 | 150 nm, 1.0 |
| Example 29 | 0.4 μm, PVDF, 1.0<br>0.1 μm, PMMA, 0.5 | 17 nm, 1.0 | 150 nm, 1.0 |
| Example 30 | 0.4 μm, PVDF, 1.0<br>0.8 μm, PMMA, 0.5 | 17 nm, 2.0 | 150 nm, 1.0 |
| Example 31 | 0.8 μm, PVDF, 1.0<br>0.1 μm, PMMA, 0.5 | 17 nm, 3.0 | 150 nm, 1.0 |
| Example 32 | 0.8 μm, PVDF, 1.0<br>0.4 μm, PMMA, 0.5 | 17 nm, 4.0 | 150 nm, 1.0 |
| Example 33 | 1.5 μm, PVDF, 1.5<br>0.4 μm, PMMA, 0.5 | 40 nm, 2.0 | 150 nm, 1.0 |
| Example 34 | 1.5 μm, PVDF, 1.5<br>0.8 μm, PMMA, 0.5 | 40 nm, 3.0 | 150 nm, 1.0 |
| Example 35 | 0.8 μm, PVDF, 1.5<br>1.5 μm, PMMA, 0.5 | 40 nm, 4.0 | 150 nm, 1.0 |
| Example 36 | 0.4 μm, silicon powder, 0.5<br>0.4 μm, PMMA, 0.5 | 6 nm, 2.0 | 150 nm, 1.0 |
| Example 37 | 0.4 μm, silicon powder, 0.5<br>0.8 μm, PMMA, 0.5 | 6 nm, 3.0 | 150 nm, 1.0 |
| Example 38 | 0.4 μm, silicon powder, 0.5<br>1.5 μm, PMMA, 0.5 | 6 nm, 4.0 | 150 nm, 1.0 |
| Example 39 | 0.8 μm, silicon powder, 1.0<br>0.4 μm, PMMA, 0.5 | 17 nm, 2.0 | 150 nm, 1.0 |
| Example 40 | 0.8 μm, silicon powder, 1.0<br>0.8 μm, PMMA, 1.0 | 17 nm, 3.0 | 150 nm, 1.0 |
| Example 41 | 0.8 μm, silicon powder, 1.0<br>1.5 μm, PMMA, 1.5 | 17 nm, 4.0 | 150 nm, 1.0 |
| Example 42 | 1.5 μm, silicon powder, 1.5<br>0.1 μm, PMMA, 0.5 | 30 nm, 1.0 | 150 nm, 1.0 |
| Example 43 | 1.5 μm, silicon powder, 1.5<br>0.8 μm, PMMA, 1.0 | 30 nm, 3.0 | 150 nm, 1.0 |

EXAMPLES 44 TO 61

To test the effect of the amount and the particle size of titanium dioxide on the toner characteristics, Examples 44 to 61 were prepared according to substantially the same method as in Example 1, except that the compositions were as shown in Table 3. The average particle size and amount of titanium dioxide ranged from 80 to 200 nm, and 0.5 to 2.0 parts by weight, respectively.

TABLE 3

| | Organic powder (average particle size, material, amount (parts by weight)) | Inorganic powder: Silica average particle size, amount (parts by weight) | Inorganic powder: Titanium dioxide average particle size, amount (parts by weight) |
|---|---|---|---|
| Example 44 | 0.1 μm, PTFE, 0.5<br>0.4 μm, PMMA, 0.5 | 6 nm, 1.0 | 80 nm, 0.5 |
| Example 45 | 0.1 μm, PTFE, 0.5<br>0.8 μm, PMMA, 0.5 | 6 nm, 2.5 | 80 nm, 1.0 |
| Example 46 | 0.1 μm, PVDF, 0.5<br>1.5 μm, PMMA, 0.5 | 6 nm, 2.5 | 80 nm, 2.0 |
| Example 47 | 0.4 μm, PVDF, 0.5<br>1.5 μm, PMMA, 0.5 | 6 nm, 2.5 | 150 nm, 0.5 |
| Example 48 | 0.4 μm, PVDF, 1.0<br>0.1 μm, PMMA, 0.5 | 6 nm, 2.5 | 150 nm, 1.0 |
| Example 49 | 0.4 μm, PVDF, 1.0<br>0.8 μm, PMMA, 0.5 | 6 nm, 2.5 | 150 nm, 2.0 |
| Example 50 | 0.8 μm, PVDF, 1.0<br>0.1 μm, PMMA, 0.5 | 6 nm, 2.5 | 200 nm, 0.5 |
| Example 51 | 0.8 μm, PVDF, 1.0<br>0.4 μm, PMMA, 0.5 | 6 nm, 2.5 | 200 nm, 1.0 |
| Example 52 | 0.8 μm, PVDF, 1.0<br>1.5 μm, PMMA, 0.5 | 6 nm, 2.5 | 200 nm, 2.0 |
| Example 53 | 0.4 μm, silicon powder, 0.5<br>0.1 μm, PMMA, 0.5 | 6 nm, 2.5 | 80 nm, 0.5 |
| Example 54 | 0.4 μm, silicon powder, 0.5<br>0.8 μm, PMMA, 0.5 | 6 nm, 2.5 | 80 nm, 2.0 |
| Example 55 | 0.4 μm, silicon powder, 0.5<br>1.5 μm, PMMA, 0.5 | 6 nm, 2.5 | 150 nm, 0.5 |
| Example 56 | 0.8 μm, silicon powder, 1.0<br>0.1 μm, PMMA, 0.5 | 6 nm, 2.5 | 150 nm, 1.0 |
| Example 57 | 0.8 μm, silicon powder, 1.0<br>0.4 μm, PMMA, 0.5 | 6 nm, 2.5 | 150 nm, 2.0 |
| Example 58 | 1.5 μm, silicon powder, 1.5<br>0.1 μm, PMMA, 0.5 | 6 nm, 2.5 | 200 nm, 2.0 |

Comparative Examples 1 to 25

To compare with Examples 1 to 25, Comparative Example 1 was performed according to substantially the same method as in Example 1, except that the particle size and the amount of organic powders were as shown in Table 4. The number average particle size and amount of organic powder ranged from 0.05 to 2.0 μm, and 0.05 to 3.5 parts by weight, respectively.

TABLE 4

| | Organic powder (average particle size, material, amount (parts by weight)) | Inorganic powder: Silica average particle size, amount (parts by weight) | Inorganic powder: Titanium dioxide average particle size, amount (parts by weight) |
|---|---|---|---|
| Comparative Example 1 | 0.05 μm, PTFE, 0.05<br>0.4 μm, PMMA, 0.5 | 6 nm, 2.5 | 150 nm, 1.0 |

TABLE 4-continued

| | Organic powder (average particle size, material, amount (parts by weight)) | Inorganic powder: Silica average particle size, amount (parts by weight) | Inorganic powder: Titanium dioxide average particle size, amount (parts by weight) |
|---|---|---|---|
| Comparative Example 2 | 0.05 μm, PTFE, 0.05<br>0.8 μm, PMMA, 0.5 | 6 nm, 2.5 | 150 nm, 1.0 |
| Comparative Example 3 | 0.05 μm, PTFE, 0.05<br>1.5 μm, PMMA, 0.5 | 6 nm, 2.5 | 150 nm, 1.0 |
| Comparative Example 4 | 2.0 μm, PVDF, 2.5<br>0.4 μm, PMMA, 0.5 | 6 nm, 2.5 | 150 nm, 1.0 |
| Comparative Example 5 | 2.0 μm, PVDF, 2.5<br>0.8 μm, PMMA, 0.5 | 6 nm, 2.5 | 150 nm, 1.0 |
| Comparative Example 6 | 2.0 μm, PVDF, 2.5<br>1.5 μm, PMMA, 0.5 | 6 nm, 2.5 | 150 nm, 1.0 |
| Comparative Example 7 | 0.1 μm, PVDF, 2.5<br>0.05 μm, PMMA, 0.05 | 6 nm, 2.5 | 150 nm, 1.0 |
| Comparative Example 8 | 0.1 μm, PVDF, 1.0<br>2.0 μm, PMMA, 3.0 | 6 nm, 2.5 | 150 nm, 1.0 |
| Comparative Example 9 | 0.4 μm, PVDF, 1.0<br>2.0 μm, PMMA, 3.0 | 6 nm, 2.5 | 150 nm, 1.0 |
| Comparative Example 10 | 0.8 μm, PVDF, 1.0<br>2.0 μm, PMMA, 3.0 | 6 nm, 2.5 | 150 nm, 1.0 |
| Comparative Example 11 | 1.5 μm, PVDF, 1.0<br>2.0 μm, PMMA, 3.0 | 6 nm, 2.5 | 150 nm, 1.0 |
| Comparative Example 12 | 0.05 μm, PVDF, 0.05<br>2.0 μm, PMMA, 3.0 | 6 nm, 2.5 | 150 nm, 1.0 |
| Comparative Example 13 | 0.05 μm, silicon powder, 0.05<br>0.1 μm, PMMA, 0.5 | 6 nm, 2.5 | 150 nm, 1.0 |
| Comparative Example 14 | 0.05 μm, silicon powder, 0.05<br>0.4 μm, PMMA, 0.5 | 6 nm, 2.5 | 150 nm, 1.0 |
| Comparative Example 15 | 0.05 μm, silicon powder, 0.05<br>0.8 μm, PMMA, 0.5 | 6 nm, 2.5 | 150 nm, 1.0 |
| Comparative Example 16 | 0.05 μm, silicon powder, 0.05<br>1.5 μm, PMMA, 0.5 | 6 nm, 2.5 | 150 nm, 1.0 |
| Comparative Example 17 | 0.05 μm, silicon powder, 0.05<br>2.0 μm, PMMA, 3.0 | 6 nm, 2.5 | 150 nm, 1.0 |
| Comparative Example 18 | 0.1 μm, silicon powder, 1.0<br>0.05 μm, PMMA, 0.05 | 6 nm, 2.5 | 150 nm, 1.0 |
| Comparative Example 19 | 0.4 μm, silicon powder, 1.0<br>0.05 μm, PMMA, 0.05 | 6 nm, 2.5 | 150 nm, 1.0 |
| Comparative Example 20 | 0.8 μm, silicon powder, 1.0<br>0.05 μm, PMMA, 0.05 | 6 nm, 2.5 | 150 nm, 1.0 |
| Comparative Example 21 | 1.5 μm, silicon powder, 1.5<br>0.05 μm, PMMA, 0.05 | 6 nm, 2.5 | 150 nm, 1.0 |
| Comparative Example 22 | 0.4 μm, silicon powder, 1.0<br>2.0 μm, PMMA, 3.5 | 6 nm, 2.5 | 150 nm, 1.0 |
| Comparative Example 23 | 0.8 μm, silicon powder, 1.0<br>2.0 μm, PMMA, 3.5 | 6 nm, 2.5 | 150 nm, 1.0 |
| Comparative Example 24 | 1.5 μm, silicon powder, 1.0<br>2.0 μm, PMMA, 3.5 | 6 nm, 2.5 | 150 nm, 1.0 |
| Comparative Example 25 | 2.0 μm, silicon powder, 2.5<br>2.0 μm, PMMA, 3.5 | 6 nm, 2.5 | 150 nm, 1.0 |

Comparative Examples 26 to 42

To compare with Examples 26 to 43, Comparative Examples 26 to 42 were performed according to substantially the same method as in Example 1, except that the particle size and the amount of silica were as shown in Table 5. The number average particle size and amount of organic powder ranged from 2 to 50 nm, and 0.5 to 5.0 parts by weight, respectively.

TABLE 5

| | Organic powder (average particle size, material, amount (parts by weight)) | Inorganic powder: Silica average particle size, amount (parts by weight) | Inorganic powder: Titanium dioxide average particle size, amount (parts by weight) |
|---|---|---|---|
| Comparative Example 26 | 0.1 μm, PTFE, 0.5<br>0.4 μm, PMMA, 0.5 | 2 nm, 1.0 | 150 nm, 1.0 |
| Comparative Example 27 | 0.1 μm, PTFE, 0.5<br>0.8 μm, PMMA, 0.5 | 2 nm, 2.0 | 150 nm, 1.0 |
| Comparative Example 28 | 0.1 μm, PVDF, 0.5<br>1.5 μm, PMMA, 0.5 | 2 nm, 3.0 | 150 nm, 1.0 |
| Comparative Example 29 | 0.4 μm, PVDF, 0.5<br>0.8 μm, PMMA, 0.5 | 2 nm, 0.3 | 150 nm, 1.0 |
| Comparative Example 30 | 0.4 μm, PVDF, 1.0<br>0.1 μm, PMMA, 0.5 | 2 nm, 0.5 | 150 nm, 1.0 |
| Comparative Example 31 | 0.4 μm, PVDF, 1.0<br>0.8 μm, PMMA, 0.5 | 2 nm, 5.0 | 150 nm, 1.0 |
| Comparative Example 32 | 0.8 μm, PVDF, 1.0<br>0.1 μm, PMMA, 0.5 | 50 nm, 1.0 | 150 nm, 1.0 |
| Comparative Example 33 | 0.8 μm, PVDF, 1.0<br>0.4 μm, PMMA, 0.5 | 50 nm, 2.0 | 150 nm, 1.0 |
| Comparative Example 34 | 0.8 μm, PVDF, 1.0<br>1.5 μm, PMMA, 0.5 | 50 nm, 3.0 | 150 nm, 1.0 |
| Comparative Example 35 | 1.5 μm, PVDF, 1.5<br>0.4 μm, PMMA, 0.5 | 50 nm, 4.0 | 150 nm, 1.0 |
| Comparative Example 36 | 1.5 μm, PVDF, 1.5<br>0.8 μm, PMMA, 0.5 | 50 nm, 5.0 | 150 nm, 1.0 |
| Comparative Example 37 | 0.8 μm, PVDF, 1.5<br>1.5 μm, PMMA, 0.5 | 17 nm, 0.5 | 150 nm, 1.0 |
| Comparative Example 38 | 0.4 μm, silicon powder, 0.5<br>0.1 μm, PMMA, 0.5 | 17 nm, 5.0 | 150 nm, 1.0 |
| Comparative Example 39 | 0.4 μm, silicon powder, 0.5<br>0.4 μm, PMMA, 0.5 | 26 nm, 0.5 | 150 nm, 1.0 |
| Comparative Example 40 | 0.4 μm, silicon powder, 0.5<br>0.8 μm, PMMA, 0.5 | 26 nm, 5.0 | 150 nm, 1.0 |
| Comparative Example 41 | 0.4 μm, silicon powder, 0.5<br>1.5 μm, PMMA, 0.5 | 40 nm, 0.5 | 150 nm, 1.0 |
| Comparative Example 42 | 0.8 μm, silicon powder, 1.0<br>0.1 μm, PMMA, 0.5 | 40 nm, 5.0 | 150 nm, 1.0 |

Comparative Examples 43 to 58

To compare with Examples 44 to 61, Comparative Examples 43 to 58 were prepared according to substantially the same method as in Example 1, except that the particle size and the amount of the titanium dioxide were as shown in Table 6. The average particle size and amount of titanium dioxide ranged from 50 to 300 nm, and 0.5 to 5.0 parts by weight, respectively.

TABLE 6

| | Organic powder (average particle size, material, amount (parts by weight)) | Inorganic powder: Silica average particle size, amount (parts by weight) | Inorganic powder: Titanium dioxide average particle size, amount (parts by weight) |
|---|---|---|---|
| Comparative Example 43 | 0.1 μm, PTFE, 0.5<br>0.4 μm, PMMA, 0.5 | 6 nm, 1.0 | 50 nm, 0.05 |
| Comparative Example 44 | 0.1 μm, PTFE, 0.5<br>0.8 μm, PMMA, 0.5 | 6 nm, 2.5 | 50 nm, 2.5 |
| Comparative Example 45 | 0.1 μm, PVDF, 0.5<br>1.5 μm, PMMA, 0.5 | 6 nm, 2.5 | 150 nm, 0.05 |
| Comparative Example 46 | 0.4 μm, PVDF, 0.5<br>1.5 μm, PMMA, 0.5 | 6 nm, 2.5 | 150 nm, 2.5 |

TABLE 6-continued

| | Organic powder (average particle size, material, amount (parts by weight)) | Inorganic powder: Silica average particle size, amount (parts by weight) | Inorganic powder: Titanium dioxide average particle size, amount (parts by weight) |
|---|---|---|---|
| Comparative Example 47 | 0.4 μm, PVDF, 1.0<br>0.1 μm, PMMA, 0.5 | 6 nm, 2.5 | 200 nm, 0.05 |
| Comparative Example 48 | 0.4 μm, PVDF, 1.0<br>0.8 μm, PMMA, 0.5 | 6 nm, 2.5 | 200 nm, 2.5 |
| Comparative Example 49 | 0.8 μm, PVDF, 1.0<br>0.1 μm, PMMA, 0.5 | 6 nm, 2.5 | 200 nm, 0.05 |
| Comparative Example 50 | 0.8 μm, PVDF, 1.0<br>0.4 μm, PMMA, 0.5 | 6 nm, 2.5 | 250 nm, 1.0 |
| Comparative Example 51 | 0.8 μm, PVDF, 1.0<br>1.5 μm, PMMA, 0.5 | 6 nm, 2.5 | 250 nm, 2.0 |
| Comparative Example 52 | 0.4 μm, silicon powder, 0.5<br>0.1 μm, PMMA, 0.5 | 6 nm, 2.5 | 250 nm, 2.5 |
| Comparative Example 53 | 0.4 μm, silicon powder, 0.5<br>0.4 μm, PMMA, 0.5 | 6 nm, 2.5 | 250 nm, 0.05 |
| Comparative Example 54 | 0.4 μm, silicon powder, 0.5<br>0.8 μm, PMMA, 0.5 | 6 nm, 2.5 | 300 nm, 0.5 |
| Comparative Example 55 | 0.4 μm, silicon powder, 0.5<br>1.5 μm, PMMA, 0.5 | 6 nm, 2.5 | 300 nm, 1.0 |
| Comparative Example 56 | 0.8 μm, silicon powder, 1.0<br>0.1 μm, PMMA, 0.5 | 6 nm, 2.5 | 300 nm, 2.0 |
| Comparative Example 57 | 0.8 μm, silicon powder, 1.0<br>0.4 μm, PMMA, 0.5 | 6 nm, 2.5 | 300 nm, 2.5 |
| Comparative Example 58 | 0.8 μm, silicon powder, 1.0<br>0.8 μm, PMMA, 1.0 | 6 nm, 2.5 | 300 nm, 0.05 |

Comparative Examples 59 to 64

To test the effect of the sequential forming method of the first coating layer and the second coating layer on the toner characteristics, double coating layers and a single coating layer were formed on the toner particle.

The composition and preparation method of the organic powders and inorganic powders were substantially the same as those of Examples 5 to 10. The coated organic powder, the coated inorganic powder, and the toner mother particle were mixed with a HENSCHEL mixer at a tip speed of 15 m/s for 5 minutes to obtain the color toner.

TABLE 7

| | Organic powder (average particle size, material, amount (parts by weight)) | Inorganic powder: Silica average particle size, amount (parts by weight) | Inorganic powder: Titanium dioxide average particle size, amount (parts by weight) |
|---|---|---|---|
| Comparative Example 59 | 0.4 μm, PVDF, 0.5<br>1.5 μm, PMMA, 0.5 | 6 nm, 2.5 | 150 nm, 1.0 |
| Comparative Example 60 | 0.4 μm, PVDF, 1.0<br>0.1 μm, PMMA, 0.5 | 6 nm, 2.0 | 150 nm, 1.0 |
| Comparative Example 61 | 0.4 μm, PVDF, 1.0<br>0.8 μm, PMMA, 0.5 | 6 nm, 2.5 | 150 nm, 1.0 |
| Comparative Example 62 | 0.8 μm, PVDF, 1.0<br>0.1 μm, PMMA, 0.5 | 6 nm, 2.5 | 150 nm, 1.0 |
| Comparative Example 63 | 0.8 μm, PVDF, 1.0<br>0.4 μm, PMMA, 0.5 | 6 nm, 2.5 | 150 nm, 1.0 |

TABLE 7-continued

| | Organic powder (average particle size, material, amount (parts by weight)) | Inorganic powder: Silica average particle size, amount (parts by weight) | Inorganic powder: Titanium dioxide average particle size, amount (parts by weight) |
|---|---|---|---|
| Comparative Example 64 | 0.8 μm, PVDF, 1.0<br>1.5 μm, PMMA, 0.5 | 6 nm, 2.5 | 150 nm, 1.0 |

Comparative Examples 65 to 70

To test the effect of the sequential forming method of the first coating layer and the second coating layer on the toner characteristics, double coating layers and multiple coating layers were formed on the toner particle.

The composition and preparation method of the organic powders and inorganic powders were the same as those of Examples 5 to 10. The toner mother particle was mixed with one kind of organic powder in a HENSCHEL mixer at a first coating step, mixed with another kind of organic powder at a second coating step, mixed with silica at a third coating step, and mixed with titanium dioxide at a forth coating step to produce the nonmagnetic mono-component color toner. The mixing was carried out at a tip speed of 15 m/s for 5 minutes.

TABLE 8

| | Organic powder: $1^{st}$ coating step (average particle size, kind, parts by weight) | Organic powder: $2^{nd}$ coating step (average particle size, kind, parts by weight) | Inorganic powder: $3^{rd}$ coating step (silica) (average particle size, parts by weight) | Inorganic powder: $4^{th}$ coating step (titanium dioxide) (average particle size, parts by weight) |
|---|---|---|---|---|
| Comparative Example 65 | 0.4 μm, PVDF, 0.5 | 1.5 μm, PMMA, 0.5 | 6 nm, 2.5 | 150 nm, 1.0 |
| Comparative Example 66 | 0.4 μm, PVDF, 1.0 | 0.1 μm, PMMA, 0.5 | 6 nm, 2.0 | 150 nm, 1.0 |
| Comparative Example 67 | 0.4 μm, PVDF, 1.0 | 0.8 μm, PMMA, 0.5 | 6 nm, 2.5 | 150 nm, 1.0 |
| Comparative Example 68 | 0.8 μm, PVDF, 1.0 | 0.1 μm, PMMA, 0.5 | 6 nm, 2.5 | 150 nm, 1.0 |
| Comparative Example 69 | 0.8 μm, PVDF, 1.0 | 0.4 μm, PMMA, 0.5 | 6 nm, 2.5 | 150 nm, 1.0 |
| Comparative Example 70 | 0.8 μm, PVDF, 1.0 | 1.5 μm, PMMA, 0.5 | 6 nm, 2.5 | 150 nm, 1.0 |

Comparative Examples 71 to 84

To test the effect of pre-coating of the inorganic powder and the organic powder with each other on the toner characteristics, double coating layers were formed on the toner mother particle without coating the two kinds of the organic powder with each other and without coating the silica and titanium dioxide with each other before coating the toner mother particle.

The composition of the inorganic powder and the organic powder were the same as those of Example 5 to 10, but were not coated with each other before coating the toner mother particle. The toner mother particles were mixed with the uncoated two kinds of organic powder in a HENSCHEL mixer at a first step, mixed with the uncoated inorganic powders at a second step to obtain the nonmagnetic mono-component color toner. The mixing was carried out at a tip speed of 15 m/s for 5 minutes.

TABLE 9

| | Organic powder (average particle size, material, amount (parts by weight)) | Inorganic powder: Silica average particle size,, parts by weight | Inorganic powder: Titanium dioxide average particle size, parts by weight |
|---|---|---|---|
| Comparative Example 71 | 0.4 μm, PVDF, 0.5 | 6 nm, 2.5 | 150 nm, 1.0 |
| Comparative Example 72 | 0.4 μm, PVDF, 1.0 | X | 150 nm, 1.0 |
| Comparative Example 73 | 0.8 μm, PMMA, 0.5 | 6 nm, 2.5 | 150 nm, 1.0 |
| Comparative Example 74 | 0.1 μm, PMMA, 0.5 | 6 nm, 2.5 | 150 nm, 1.0 |
| Comparative Example 75 | 0.4 μm, PMMA, 0.5 | 6 nm, 2.5 | X |
| Comparative Example 76 | 0.4 μm, PMMA, 0.5 | X | 150 nm, 1.0 |
| Comparative Example 77 | 0.8 μm, PVDF, 1.0 | 6 nm, 2.5 | 150 nm, 1.0 |
| Comparative Example 78 | 0.8 μm, PVDF, 1.0 | X | 150 nm, 1.0 |

TABLE 9-continued

| | Organic powder (average particle size, material, amount (parts by weight)) | Inorganic powder: Silica average particle size,, parts by weight | Inorganic powder: Titanium dioxide average particle size, parts by weight |
|---|---|---|---|
| Comparative Example 79 | 0.8 μm, PVDF, 1.0 | 6 nm, 2.5 | X |
| Comparative Example 80 | 0.4 μm, PVDF, 0.5<br>1.5 μm, PMMA, 0.5 | 6 nm, 2.5 | 150 nm, 1.0 |

TABLE 9-continued

| | Organic powder (average particle size, material, amount (parts by weight)) | Inorganic powder: Silica average particle size,, parts by weight | Inorganic powder: Titanium dioxide average particle size, parts by weight |
|---|---|---|---|
| Comparative Example 81 | 0.4 μm, PVDF, 1.0<br>0.1 μm, PMMA, 0.5 | 6 nm, 2.0 | 150 nm, 1.0 |
| Comparative Example 82 | 0.4 μm, PVDF, 1.0<br>0.8 μm, PMMA, 0.5 | 6 nm, 2.5 | 150 nm, 1.0 |
| Comparative Example 83 | 0.8 μm, PVDF, 1.0<br>0.1 μm, PMMA, 0.5 | 6 nm, 2.5 | 150 nm, 1.0 |
| Comparative Example 84 | 0.8 μm, PVDF, 1.0<br>0.4 μm, PMMA, 0.5 | 6 nm, 2.5 | 150 nm, 1.0 |

TEST EXAMPLE 1

Each of the non-magnetic mono-component color toners prepared in the Examples and Comparative Examples were respectively used to print 5,000 sheets of paper using a tedem type of non-magnetic mono-component development printer (HP 4600, Hewlett-Packard) at room temperature and humidity (20 □, 55% RH). Image density, transfer efficiency, long-term stability, and contamination of the charging blade were tested according to the following methods.

1. Image Density (I.D)

A solid area was measured using a Macbeth reflectance densitometer RD918.

A: the image density is equal to or more than 1.4

B: the image density is equal to or more than 1.3

C: the image density is equal to or less than 1.2

D: the image density is equal to or less than 1.0

2. Transfer Efficiency

Of the 5,000 sheets of paper, printing efficiency was calculated by counting the number of wasted sheets per each 500 sheets.

A: The transfer efficiency is equal to or more than 80%

B: The transfer efficiency is 70□080%

C: The transfer efficiency is 60□70%

D: The transfer efficiency is 50□60%

3. Long-Term Stability

Whether I.D. and transfer efficiency were maintained after printing 5,000 sheets was observed.

A: I.D ≧1.4, and Transfer efficiency ≧75%;

B: I.D ≧1.3, and Transfer efficiency ≧70%;

C: I.D ≦1.2, and Transfer efficiency ≧60%;

D: I.D ≦1.0, and Transfer efficiency ≧40%;

4. Charging Blade Contamination

After printing 5,000 sheets of paper, the toner remained on the surface PCR was adhered by transparent tape to transfer to white paper and was observed under an optical microscope to evaluate according to the following criteria.

□: serious contamination on PCR

○: some contamination on PCR

□: very small amount of contamination on PCR

X: no contamination (1) The Effect of the Particle Size and Amount of Organic Powder To test the effect of the particle size and amount of organic powder, the image density, transfer efficiency, long-term stability, and PCR contamination of the nonmagnetic mono-component color toner obtained in Examples 1 to 25 and Comparative Examples 1 to 25 were measured, and the test results were shown in Table 10 as below.

TABLE 10

| | Image density | Transfer efficiency | Long-term stability | PCR contamination |
|---|---|---|---|---|
| Example 1 | A | A | B | X |
| Example 2 | B | A | B | X |
| Example 3 | A | A | A | X |
| Example 4 | A | A | A | X |
| Example 5 | A | A | A | X |
| Example 6 | A | A | A | X |
| Example 7 | A | A | A | X |
| Example 8 | A | A | A | X |
| Example 9 | A | A | A | X |
| Example 10 | A | A | A | X |
| Example 11 | A | A | A | X |
| Example 12 | A | A | A | X |
| Example 13 | A | B | A | X |
| Example 14 | A | A | A | X |
| Example 15 | A | A | A | X |
| Example 16 | A | A | A | X |
| Example 17 | A | A | A | X |
| Example 18 | A | A | A | X |
| Example 19 | B | A | A | X |
| Example 20 | A | A | A | X |
| Example 21 | A | A | A | X |
| Example 22 | A | A | A | X |
| Example 23 | A | A | A | X |
| Example 24 | A | A | A | X |
| Example 25 | A | A | B | X |
| Comparative Example 1 | D | D | D | ○ |
| Comparative Example 2 | D | D | C | ○ |
| Comparative Example 3 | C | D | D | ○ |
| Comparative Example 4 | D | D | D | □ |
| Comparative Example 5 | D | D | C | □ |
| Comparative Example 6 | C | D | D | □ |
| Comparative Example 7 | C | D | D | □ |
| Comparative Example 8 | D | D | D | □ |
| Comparative Example 9 | C | D | D | □ |
| Comparative Example 10 | C | D | D | □ |
| Comparative Example 11 | D | D | D | □ |
| Comparative Example 12 | D | D | D | □ |
| Comparative Example 13 | D | D | D | ○ |
| Comparative Example 14 | D | C | D | ○ |
| Comparative Example 15 | D | D | D | ○ |
| Comparative Example 16 | D | D | D | ○ |
| Comparative Example 17 | C | D | D | □ |
| Comparative Example 18 | D | D | D | ○ |
| Comparative Example 19 | D | D | D | ○ |
| Comparative Example 20 | D | D | D | ○ |
| Comparative Example 21 | D | D | D | ○ |
| Comparative Example 22 | D | D | D | □ |
| Comparative Example 23 | D | D | D | □ |
| Comparative Example 24 | D | D | D | □ |
| Comparative Example 25 | D | D | D | □ |

As shown in Table 10, the color toners obtained in Examples 1 to 25 where the toner mother particles were coated by coated organic powders, and then coated by the coated silica and titanium dioxide had excellent image density, transfer efficiency, and long-term stability, compared to those of Comparative Examples 1 to 25. Such results show that the toner mother particles behaved like a spherical shaped toner after coating by the coated organic powders, and thus the coated silica and titanium dioxide adhered to the toner easily. In addition, it reduced the adhesion force between the toner particles, thereby being helpful for maintaining charge capacity.

(2) The Effect of the Particle Size and Amount of Silica Power

To test the effect of the particle size and amount of silica powder on the toner characteristics, the image density, transfer efficiency, long-term stability, and PCR contamination of the nonmagnetic mono-component color toner obtained in Examples 26 to 42 and Comparative Examples 26 to 42 were measured, and the test results are shown in Table 11 below.

TABLE 11

| | Image density | Transfer efficiency | Long-term stability | PCR contamination |
|---|---|---|---|---|
| Example 26 | A | A | A | X |
| Example 27 | A | A | A | X |
| Example 28 | A | A | A | X |
| Example 29 | A | A | A | X |
| Example 30 | A | A | A | X |
| Example 31 | A | A | A | X |
| Example 32 | A | A | A | X |
| Example 33 | A | A | A | X |
| Example 34 | A | A | A | X |
| Example 35 | A | A | A | X |
| Example 36 | A | A | A | X |
| Example 37 | A | A | A | X |
| Example 38 | B | A | A | X |
| Example 39 | A | A | B | X |
| Example 40 | A | A | A | X |
| Example 41 | A | A | A | X |
| Example 42 | A | A | A | X |
| Comparative Example 26 | D | D | D | ○ |
| Comparative Example 27 | D | D | D | ○ |
| Comparative Example 28 | D | D | D | ○ |
| Comparative Example 29 | D | D | D | □ |
| Comparative Example 30 | D | D | D | ○ |
| Comparative Example 31 | D | D | D | □ |
| Comparative Example 32 | D | D | D | □ |
| Comparative Example 33 | D | D | D | □ |
| Comparative Example 34 | D | D | D | ○ |
| Comparative Example 35 | D | D | D | ○ |
| Comparative Example 36 | D | D | D | ○ |
| Comparative Example 37 | D | D | D | □ |
| Comparative Example 38 | D | D | D | □ |
| Comparative Example 39 | D | C | D | □ |
| Comparative Example 40 | D | D | D | ○ |
| Comparative Example 41 | D | D | D | □ |
| Comparative Example 42 | D | D | D | ○ |

As shown in Table 11, the color toners obtained in Examples 28 to 50 where the average particle size and amount of silica were 3 to 40 nm and 1 to 4 parts by weight, respectively show excellent image density, transfer efficiency, and prevention of PCR contamination, compared to those of Comparative Examples 26 to 42.

(2) The Effect of the Particle Size and Amount of Titanium Dioxide

To test the effect of the particle size and amount of titanium dioxide on the toner characteristics, the image density, transfer efficiency, long-term stability, and PCR contamination of the nonmagnetic mono-component color toner obtained in Examples 43 to 58 and Comparative Examples 43 to 58 were measured, and the test results are shown in Table 12 below.

TABLE 12

| | Image density | Transfer efficiency | Long-term stability | PCR contamination |
|---|---|---|---|---|
| Example 43 | A | A | A | X |
| Example 44 | A | B | A | X |
| Example 45 | A | A | A | X |
| Example 46 | A | A | A | X |
| Example 47 | A | A | A | X |
| Example 48 | A | A | A | X |
| Example 49 | A | A | A | X |
| Example 50 | A | A | A | X |
| Example 51 | A | A | A | X |
| Example 52 | A | A | A | X |
| Example 53 | A | A | A | X |
| Example 54 | A | A | A | X |
| Example 55 | A | A | A | X |
| Example 56 | B | A | A | X |
| Example 57 | A | A | A | X |
| Example 58 | A | A | A | X |
| Comparative Example 43 | D | D | D | □ |
| Comparative Example 44 | C | D | D | ○ |
| Comparative Example 45 | D | D | D | □ |
| Comparative Example 46 | D | D | D | ○ |
| Comparative Example 47 | D | D | C | □ |
| Comparative Example 48 | D | D | D | ○ |
| Comparative Example 49 | D | D | D | □ |
| Comparative Example 50 | D | D | D | ○ |
| Comparative Example 51 | D | D | D | ○ |
| Comparative Example 52 | D | D | D | ○ |
| Comparative Example 53 | D | C | D | □ |
| Comparative Example 54 | D | D | D | □ |
| Comparative Example 55 | D | D | D | ○ |
| Comparative Example 56 | D | D | D | ○ |
| Comparative Example 57 | D | D | D | ○ |
| Comparative Example 58 | D | D | D | ○ |

As shown in Table 12, the color toners obtained in Examples 43 to 58 where the average particle size and the amount of titanium dioxide were 80 to 200 nm and 0.1 to 2.0 parts by weight, respectively show excellent image density, transfer efficiency, and prevention of PCR contamination, compared to those of Comparative Examples 43 to 58.

(4) The Difference Between Double Coating Layers Prepared by Multi-Steps, and a Single Coating Layer To test the difference between double coating layers prepared by sequential coating in two steps according to the present invention, and a single coating layer with the same composition of the double coating layers, the image density, transfer efficiency, long-term stability, and PCR contamination of the nonmagnetic mono-component color toner obtained in Examples 5 to 10 and Comparative Examples 59 to 64 were measured, and the test results are shown in Table 13 below.

TABLE 13

| | Image density | Transfer efficiency | Long-term stability | PCR contamination |
|---|---|---|---|---|
| Example 5 | A | A | A | X |
| Example 6 | A | B | A | X |
| Example 7 | A | A | A | X |
| Example 8 | A | A | A | X |
| Example 9 | A | A | A | X |
| Example 10 | A | A | A | X |
| Comparative Example 59 | C | D | D | □ |
| Comparative Example 60 | C | D | D | ○ |
| Comparative Example 61 | B | D | D | □ |
| Comparative Example 62 | C | D | D | ○ |
| Comparative Example 63 | C | D | D | □ |
| Comparative Example 64 | B | D | D | □ |

As shown in Table 13, the color toners with double coating layers obtained in Examples 5 to 10 show excellent characteristics, compared to the color toners with the single coating layer obtained in Comparative Examples 59 to 64.

More specifically, even though the color toners of Comparative Examples 59 to 64 included the same particle size and composition of the organic powders and inorganic powders as those of Examples 5 to 10, they had poor transfer efficiency and long-term stability, and serious contamination of the PCR. Such results show that the single coating layer of organic powders or inorganic powders formed on the toner mother particles could not present their inherent characteristics.

(5) The Difference Between the Double Coating Layers and Mutiple Coating Layers

To test the difference between the double coating layers prepared by sequential coating in two steps according to the present invention, and the multiple coating layers with the same composition of the double coating layers, the image density, transfer efficiency, long-term stability, and PCR contamination of the nonmagnetic mono-component color toner obtained in Examples 5 to 10 and Comparative Examples 65 to 70 were measured, and the test results are shown in Table 14 below.

TABLE 14

| | Image density | Transfer efficiency | Long-term stability | PCR contamination |
|---|---|---|---|---|
| Comparative Example 65 | D | C | C | ○ |
| Comparative Example 66 | C | D | D | ○ |
| Comparative Example 67 | B | D | D | ○ |

TABLE 14-continued

| | Image density | Transfer efficiency | Long-term stability | PCR contamination |
|---|---|---|---|---|
| Comparative Example 68 | C | D | D | ○ |
| Comparative Example 69 | C | D | D | □ |
| Comparative Example 70 | B | D | D | □ |

As shown Table 14, the toners with double coating layers of Examples 5 to 10 had better characteristics than those of Comparative Examples 65 to 70 with multiple coating layers.

More specifically, even though the color toners of Comparative Examples 65 to 70 included the same particle size and composition of the organic powders and inorganic powders as those of Examples 5 to 10, they had poor transfer efficiency and long-term stability, and serious contamination of the PCR. From this result, the toner prepared by the two-step coating process of the present invention where the organic powders and inorganic powders were coated with each other before coating the toner mother particles had the best characteristics.

(6) The Effect of Coating the Organic Powders and Inorganic Powders Before Coating the Surface of the Toner Mother Particle To test the difference between use of the organic powders and inorganic powders coated with each other according to the present invention, and use of uncoated organic or inorganic powders, the image density, transfer efficiency, long-term stability, and PCR contamination of the nonmagnetic mono-component color toner obtained in Examples 5 to 10 and Comparative Examples 71 to 82 were measured, and the test results are shown in Table 15 below.

TABLE 15

| | Image density | Transfer efficiency | Long-term stability | PCR contamination |
|---|---|---|---|---|
| Comparative Example 71 | D | C | C | ○ |
| Comparative Example 72 | C | D | D | ○ |
| Comparative Example 73 | D | D | D | ○ |
| Comparative Example 74 | C | D | D | ○ |
| Comparative Example 75 | D | D | D | □ |
| Comparative Example 76 | C | D | D | □ |
| Comparative Example 77 | D | C | D | □ |
| Comparative Example 78 | C | D | D | □ |
| Comparative Example 79 | D | D | C | □ |
| Comparative Example 80 | D | D | D | □ |
| Comparative Example 81 | D | C | C | ○ |
| Comparative Example 82 | C | D | D | ○ |
| Comparative Example 83 | D | D | D | ○ |
| Comparative Example 84 | D | D | C | ○ |

As shown in Table 15, the toner which was formed with the first coating layer and the second coating layer after the organic powders and inorganic powders were coated with each other, respectively represented better toner characteristics than otherwise.

More specifically, even though the color toners of Comparative Examples 71 to 84 included the same particle size and composition of the organic powders and inorganic powders as those of Examples 5 to 10, they had poor transfer efficiency and long-term stability, and serious contamination of the PCR.

TEST EXAMPLE 2

To examine the surface state of the first coating layer and the second coating layer, the toner particle with the first coating layer of the coated organic powders, and the toner particle sequentially coated by the second coating layer of the coated inorganic powders according to Example 1 were observed under SEM.

Figure 2:
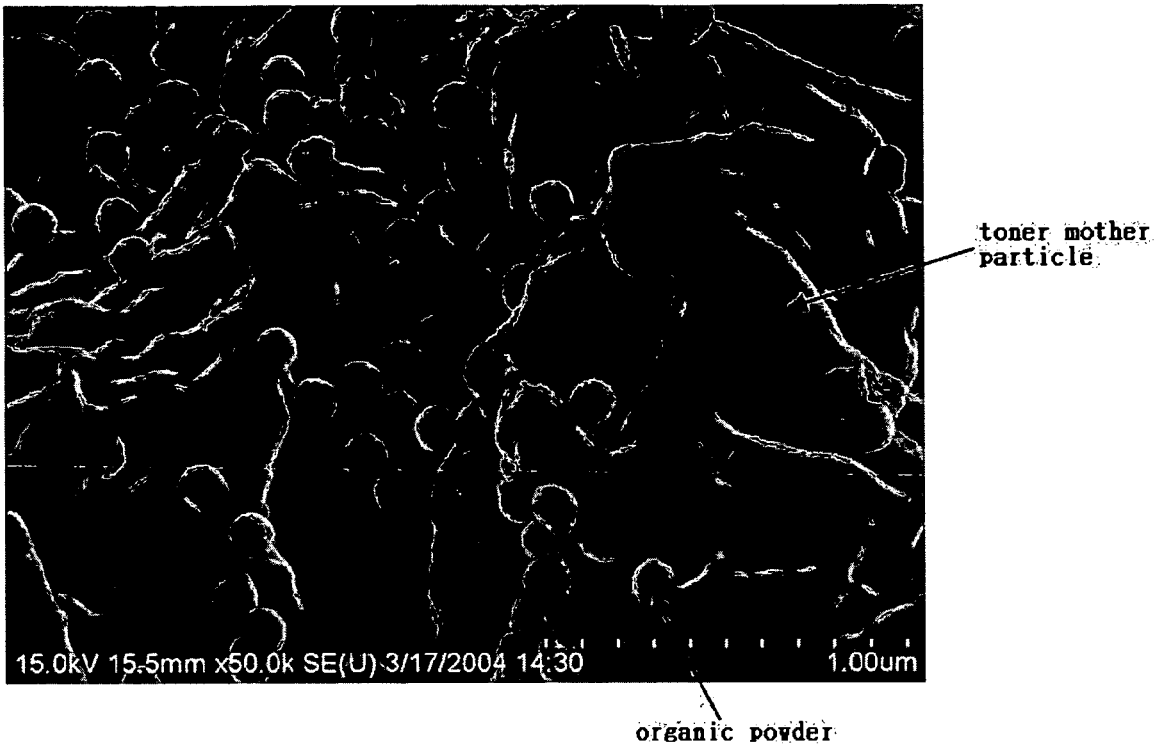
FIG. 2 is a scanning electron microscopy (SEM) photograph showing the surface state of a toner mother particle after forming the first coating layer obtained according to one preferred embodiment.
Figure 4:
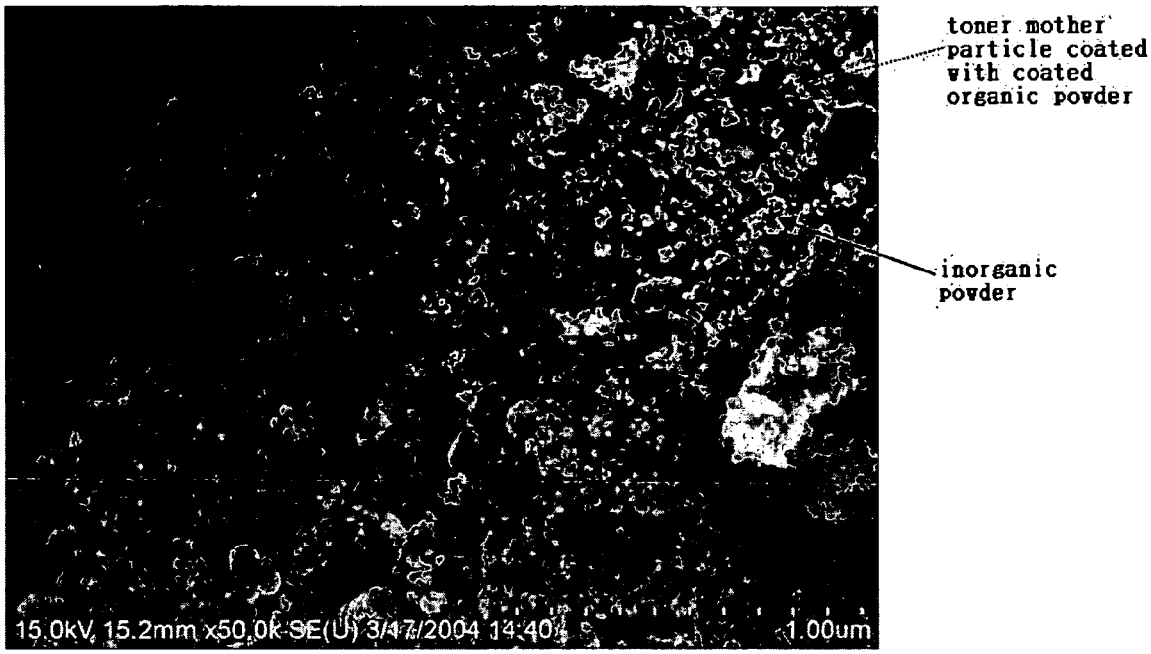
FIG. 4 is a SEM photograph showing the surface state of the particle coated with the first and second layers, after obtaining the second coating layer, according to one preferred embodiment.

FIG. 2 is an SEM photograph showing the surface state of the particle with the first coating layer. FIG. 4 is a scanning electronic microscope photograph showing the surface state of a particle with the first coating layer and the second coating layer.

Figure 3:
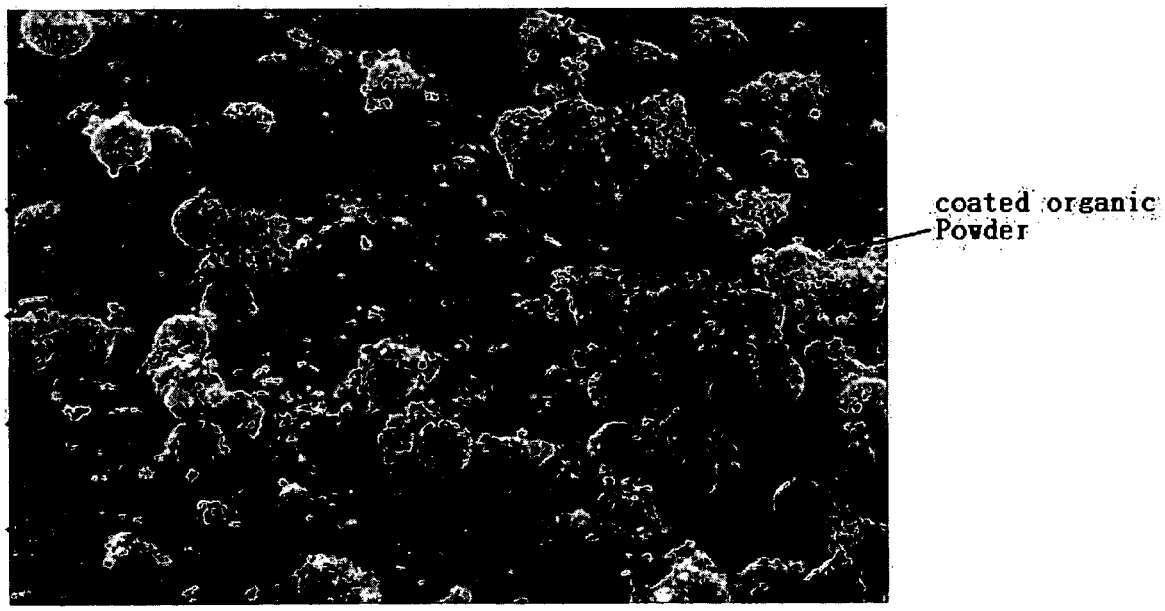
FIG. 3 is a SEM photograph showing the surface state of a coated organic powder that is formed on the toner mother particle according to one preferred embodiment after obtaining the first coating layer.

As shown in FIG. 2, the surface of the toner mother particle is very irregular, and the organic powder fills up the recess portion of the toner mother particle. FIG. 3 shows that two kinds of organic powders were coated with each other.

Figure 5:
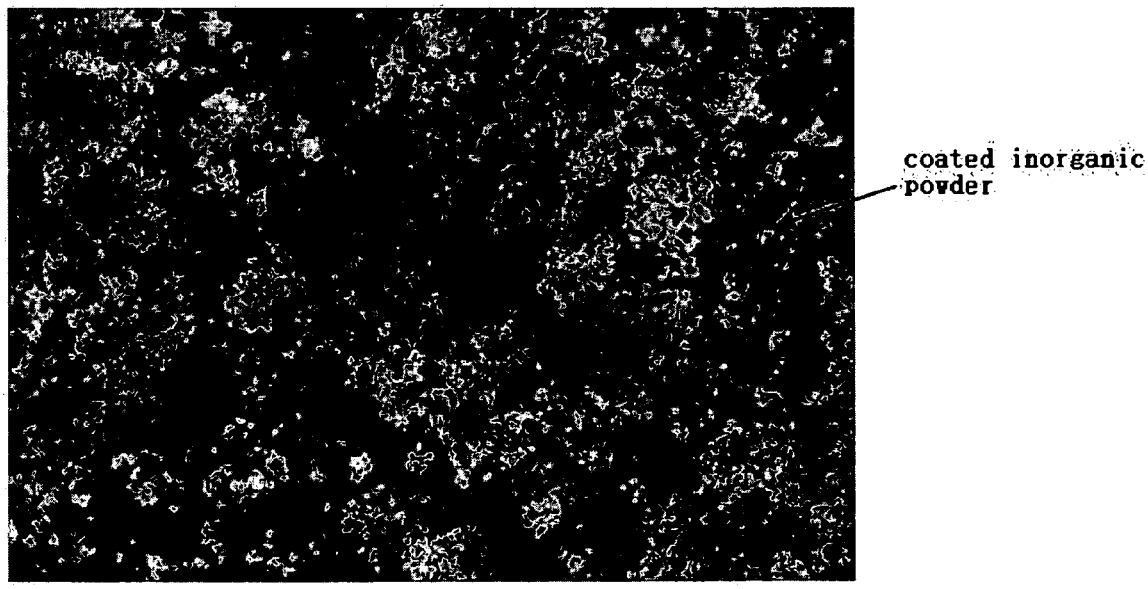
FIG. 5 is a SEM photograph showing the surface state of the coated inorganic powder that is formed on a toner mother particle with the first coating layer, after obtaining the second coating layer, according to one preferred embodiment.

As shown in FIG. 4, the surface state of the toner mother particle was relatively even because of the first coating layer, and the coated inorganic powders coated the even surface of the toner particle. FIG. 5 shows that the inorganic powders were coated with each other.

What is claimed is:

1. A color toner for a non-magnetic mono-component printing system comprising a first coating layer and a second coating layer formed on a toner mother particle, wherein the first coating layer contains coated organic powders where two kinds of organic powders having an average particle size of 0.1 μm to 1.8 μm are coated with each other, the two kinds of the organic powders being in an amount of 0.1 to 2.0 parts by weight respectively, based on 100 parts by weight of the toner mother particle, and the second coating layer contains coated inorganic powders where silica having an average particle size of 3 nm to 40 nm and titanium dioxide having an average particle size of 80 nm to 200 nm are coated with each other, the silica being in an amount of 1.0 to 4.0 parts by weight and the titanium dioxide being in an amount of 0.1 to 2.0 parts by weight, based on 100 parts by weight of the toner mother particle.

2. The color toner of claim 1, wherein the first coating layer has a thickness of 10 nm to 200 nm.

3. The color toner of claim 1, wherein the organic powder is:

(a) a homopolymer or a copolymer prepared from one or more monomers selected from the group consisting of styrene compounds, vinylhalides, vinylesters, methacrylates, acrylic acid derivatives, acrylates, tetrafluoroethylene, and 1,1-difluoroethylene; or (b) a mixture of a polymer selected from the group consisting of the homopolymer and the copolymer of (a), and a resin selected from the group consisting of styrene-based resin, epoxy-based resin, polyester-based resin, and polyurethane-based resin.

4. The color toner of claim 3, wherein the styrene compound is selected from the group consisting of styrene, methyl styrene, dimethyl styrene, ethyl styrene, phenyl styrene, chloro styrene, hexyl styrene, octyl styrene, and nonyl styrene;

the vinylhalide is selected from the group consisting of vinylchloride and vinylfluoride;

the vinylester is selected from the group consisting of vinylacetate and vinylbenzoate;

the methacrylate is selected from the group consisting of methylmethacrylate, ethyl methacrylate, propylmethacrylate, n-butylmethacrylate, iso-butylmethacrylate, 2-ethylhexyl methacrylate, and phenyl methacrylate;

the acrylic acid derivative is selected from the group consisting of acrylonitrile and methacrylonitrile; and the acrylate is selected from the group consisting of methylacrylate, ethylacrylate, butylacrylate, and phenylacrylate.

5. The color toner of claim 1, wherein the thickness of the second coating layer is 3 nm to 400 nm.

6. The color toner of claim 1, wherein the silica is silica itself, or hydrophobically-treated silica modified by a surface modifying agent selected from the group consisting of dimethyl dichlorosilane, dimethylpolysiloxane, hexamethyldisilazane, aminosilane, alkylsilane, and octamethyl cyclotetrasiloxane.

7. The color toner of claim 1, wherein the titanium dioxide is selected from the group consisting of Rutile type titanium dioxide, Anatase type titanium dioxide, and a mixture thereof.

8. The color toner of claim 1, wherein the toner mother particle comprises a binder region, a colorant, and a charge control agent.

9. The color toner of claim 8, wherein the toner mother particle further comprises at least one selected from the group consisting of a fluidity promoting agent and a release agent.

10. A process of preparing a color toner for a nonmagnetic mono-component printing system comprising the steps of:

a) preparing a coated organic powder by mixing and coating two kinds of organic powder having an average particle size of 0.1 μm to 1.8 μm with each other, in an amount of 0.1 to 2.0 parts by weight respectively, based on 100 parts by weight of a toner mother particle;

b) coating the coated organic powders on the toner mother particle to produce the toner mother particle with a first coating layer;

c) preparing coated inorganic powders by mixing and coating silica having an average particle size of 3 nm to 40 nm and titanium dioxide having an average particle size of 80 nm to 200 nm with each other, the silica being in an amount of 1.0 to 4.0 parts by weight and the titanium dioxide being in an amount of 0.1 to 2.0 parts by weight, based on 100 parts by weight of the toner mother particle; and d) coating the coated inorganic powders on the toner mother particle with the first coating layer of step b) to produce a toner particle comprising the first coating layer and the second coating layer formed on the toner mother particle.

11. The process of preparing the color toner of claim 10, wherein the mixing in steps a) to d) is performed by a mixer selected from the group consisting of a Henschel mixer, a turbine agitator, a super mixer, and a hybridizer.

* * * * *